US006105551A

United States Patent [19]

Nakano et al.

[11] Patent Number: 6,105,551

[45] Date of Patent: Aug. 22, 2000

[54] REVOLUTION SPEED CONTROL APPARATUS FOR AN INTERNAL COMBUSTION ENGINE

[75] Inventors: Shuuji Nakano; Yoshihito Moriya, both of Nagoya; Hideo Nagaosa; Shinichiro Kikuoka, both of Aichi-ken, all of Japan

[73] Assignee: Toyota Jidosha Kabushiki Kaisha, Toyota, Japan

[21] Appl. No.: 09/352,336

[22] Filed: Jul. 13, 1999

[30] Foreign Application Priority Data

Sep. 28, 1998 [JP] Japan ..... 10-273766

[51] Int. Cl.[7] ..... F02D 13/02; F02D 41/22

[52] U.S. Cl. ..... 123/333; 123/90.18; 123/403

[58] Field of Search ..... 123/90.15, 90.16, 123/90.17, 198 D, 198 DB, 331, 333, 335, 403

[56] References Cited

U.S. PATENT DOCUMENTS

| | | | |
|---|---|---|---|
| 4,517,936 | 5/1985 | Burgio Di Aragona | 123/90.5 |
| 4,693,214 | 9/1987 | Titolo | 123/90.18 |
| 4,773,359 | 9/1988 | Titolo | 123/90.22 |
| 5,417,191 | 5/1995 | Togai et al. | 123/333 |
| 5,730,103 | 3/1998 | Takizawa et al. | 123/333 |

FOREIGN PATENT DOCUMENTS

| | | |
|---|---|---|
| 0 843 080 | 5/1998 | European Pat. Off. . |
| A-64-19131 | 1/1989 | Japan . |

OTHER PUBLICATIONS

Patent Abstracts of Japan, vol. 1995, No. 2, abstract of JP–06–317208, Mar. 1995.

Patent Abstracts of Japan, vol. 16, No. 72, abstract of JP–03–260353, Feb. 1992.

Titolo, A. "The Variable Valve Timing System—Application on a V8 Engine", SAE 910009, pp. 8–15.(1991).

*Primary Examiner*—Tony M. Argenbright

*Attorney, Agent, or Firm*—Oliff & Berridge, PLC

[57] ABSTRACT

A revolution speed control apparatus is provided. In particular, a variable valve drive apparatus for an internal combustion engine is provided, capable of continuously and variably setting a valve lift in conjunction with use of a three-dimensional cam. The apparatus provides a proper fail-safe system by setting an appropriate allowable engine revolution speed. An actual amount of adjustment in the position of a cam shaft, that is performed by a valve lift varying actuator, is detected by a shaft position sensor. Based on the actual amount of adjustment, the apparatus determines a cam profile of each intake cam contacting the corresponding cam follower. That is, the apparatus determines what portion of the oblique cam surface of each intake cam is providing a present valve lift. A valve lift is thus specified in addition to other parameters needed to determine an allowable revolution speed. These parameters include the valve spring load and the valve mass, for example. As a result, it becomes possible to set a precise allowable revolution speed. Based on the set allowable revolution speed, the apparatus determines whether the state of the actual revolution speed is appropriate. If the actual revolution speed is equal to or higher than the allowable revolution speed, the engine revolution speed can be properly reduced. This may be performed by implementing a fuel-cut.

18 Claims, 5 Drawing Sheets

REVOLUTION SPEED CONTROL APPARATUS FOR AN INTERNAL COMBUSTION ENGINE

INCORPORATION BY REFERENCE

The disclosure of Japanese Patent Application No. Hei 10-273766 filed on Sep. 28, 1998 including the specification, drawings and abstract is incorporated herein by reference in its entirety.

BACKGROUND OF THE INVENTION

1. Field of the Invention

The present invention relates to a revolution speed control apparatus for an internal combustion engine. In particular, the invention relates to a revolution speed control apparatus for an internal combustion engine that employs a variable valve drive device incorporating a three-dimensional cam whose profile continuously changes in a direction of a rotational axis of the cam.

2. Description of the Related Art

A known variable valve drive device for intake or exhaust valves of an internal combustion engine switches between a valve lift set for low revolution speeds of the engine and a valve lift set for high revolution speeds. This is performed by hydraulically switching between a low speed cam and a high speed cam, as described in, for example, Japanese Patent Application Laid-Open No. Hei 1-19131.

This technology employs countermeasures against reductions in the responsiveness of the switching from the low speed cam to the high speed cam caused by low hydraulic fluid viscosity at low temperatures. That is, during a low temperature condition, the variable valve drive device maintains operation of the low speed cam, and stops the fuel supply to the internal combustion engine if the engine revolution speed becomes high.

However, if the temperature is not low, the variable valve drive device controls the switching between the low speed cam and the high speed cam merely by controlling the cam switching fluid pressure, and does not check whether the cam is actually switched. Therefore, if the low speed cam is not switched to the high speed cam, for any reason, at the time of a high engine revolution speed, the variable valve drive device is not able to perform a fail-safe operation, such as a fuel cut operation, or the like.

In addition to the above-described system for switching between the low and high speed cams, another variable valve drive device is known which employs a three-dimensional cam whose cam profile continuously changes in the direction of the rotational axis of the cam, i.e., to adjust the valve lift. In some systems employing such three-dimensional cams, the valve lift adjustment involves, as parameters, not only the revolution speed of the internal combustion engine, but also engine loads including the intake pressure, the amount of intake air, the amount of fuel, and the like. In such a system, detection of an actual revolution speed is not sufficient to determine a single cam profile to be engaged. Therefore, if the control is solely based on detection of the engine revolution speed, it is impossible to determine a valve lift and set an allowable revolution speed. Hence, a mere application of the conventional technology, for switching between a low speed cam and a high speed cam, to a variable valve drive device employing a three-dimensional cam results in difficulty to establish a fail-safe system.

SUMMARY OF THE INVENTION

Accordingly, it is an object of the present invention to provide a fail-safe system variable valve drive device employing a three-dimensional cam to continuously variably set the valve lift, by setting an appropriate allowable revolution speed.

A revolution speed control apparatus for an internal combustion engine according to the invention includes a three-dimensional cam provided on a camshaft of the internal combustion engine. The three-dimensional cam has a cam surface that contacts a cam follower drivingly connected to a valve. The three-dimensional cam has a cam profile that varies continuously in a direction of a rotational axis of the three-dimensional cam. The apparatus further includes a valve lift varying actuator capable of continuously varying a valve lift of the valve caused by the three-dimensional cam, by adjusting a position of the camshaft in the direction of the rotational axis. The apparatus further includes an adjustment amount detector that detects an amount of adjustment provided by the valve lift varying actuator, an allowable revolution speed setter that determines an allowable revolution speed of the internal combustion engine in accordance with the amount of adjustment detected by the adjustment amount detector, an engine revolution speed detector that detects a revolution speed of the internal combustion engine, and an engine revolution speed reducer that reduces the revolution speed of the internal combustion engine if the revolution speed detected by the engine revolution speed detector is greater than the allowable revolution speed set by the allowable revolution speed setter.

In the above-described revolution speed control apparatus, the adjustment amount detector directly detects the state of, or the amount of, adjustment performed by the valve lift varying actuator. Based on this detection, the apparatus determines a cam profile of the cam contacting the cam follower, that is, finds what portion of an oblique cam surface of the cam is providing a present valve lift. A valve lift cam profile is thus specified in addition to other parameters needed to determine an allowable revolution speed. These other parameters may include the valve spring load, the valve mass, and the like. As a result, it is possible to set a precise allowable revolution speed. Thus, the allowable revolution speed setter can be set by an appropriate allowable revolution speed, which corresponds to the valve lift. By using this appropriate allowable revolution speed, the engine revolution speed reducer reduces the revolution speed of the internal combustion engine to a proper range. Therefore, the apparatus of the invention is able to provide a proper fail-safe system and prevent problems in an internal combustion engine.

The engine revolution speed reducer may reduce the revolution speed of the internal combustion engine by stopping a fuel supply to the internal combustion engine. This operation is generally referred to as a fuel-cut.

Furthermore, the allowable revolution speed setter may set the allowable revolution speed by continuously varying the allowable revolution speed in accordance with the valve lift corresponding to the amount of adjustment.

If the valve lift increases, the valve spring is compressed. As a result, the allowable revolution speed tends to continuously increase in some cases. However, in some other cases, as the valve lift increases, the allowable revolution speed exhibits other continuous changing patterns, depending on the specifications of the valve spring and the profile of the cam surface. Considering such characteristics, the setting of the allowable revolution speed can be adapted to the characteristics of the three-dimensional cam and the valve spring. This is performed by continuously varying the allowable revolution speed in accordance with changes in the valve lift corresponding to the amount of adjustment. Therefore, the apparatus of the invention is able to set a more precise allowable revolution speed, and provide a proper fail-safe system and prevent problems in an internal combustion engine.

BRIEF DESCRIPTION OF THE DRAWINGS

The foregoing and further objects, features and advantages of the present invention will become apparent from the following description of exemplary embodiments with reference to the accompanying drawings, wherein like numerals are used to represent like elements and wherein.

DETAILED DESCRIPTION OF PREFERRED EMBODIMENTS

Figure 1:
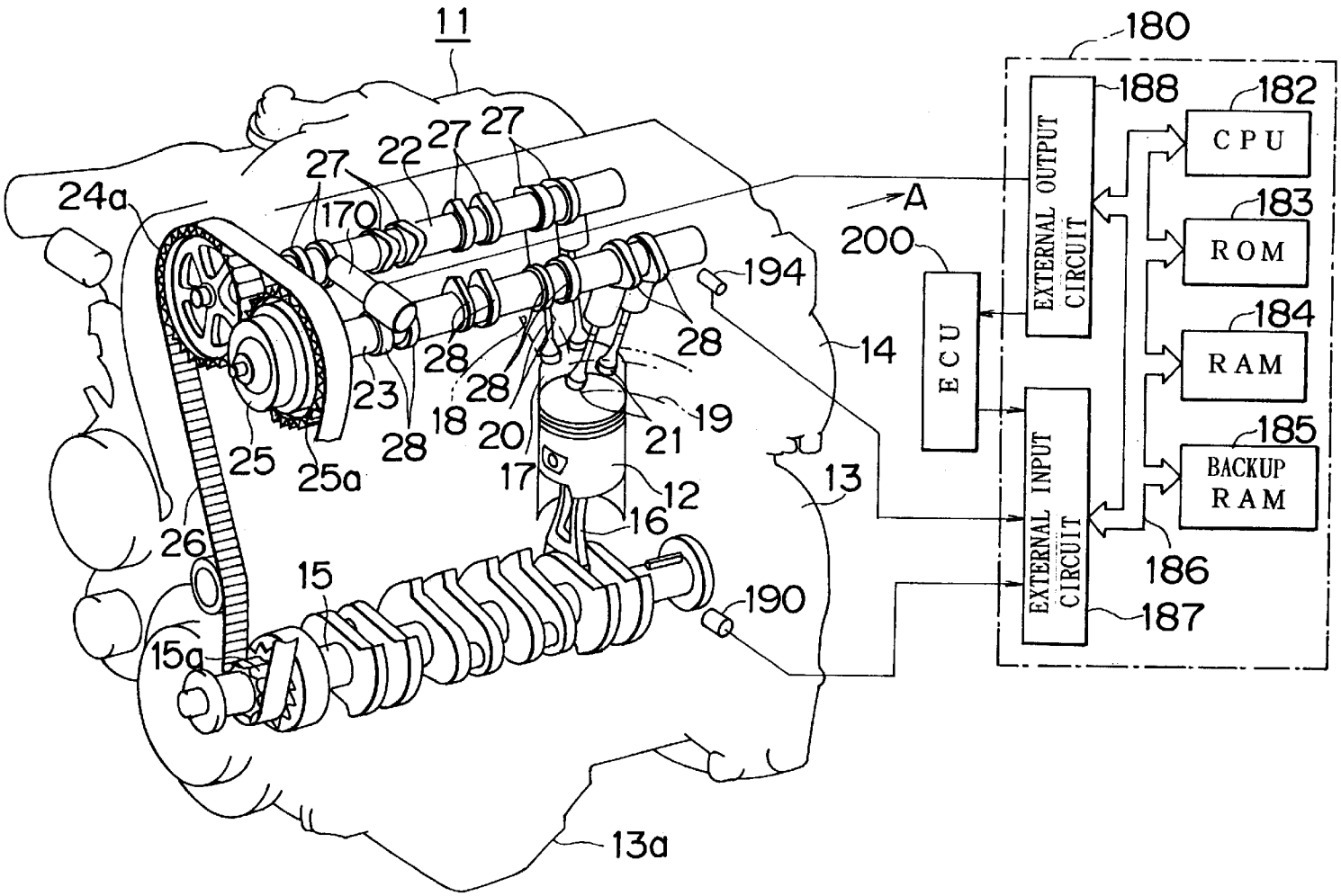
FIG. 1 is a schematic illustration of an internal combustion engine including a block diagram of an engine revolution speed control apparatus according to a first embodiment of the invention.

While the invention will hereinafter be described in connection with exemplary embodiments thereof, it will be understood that it is not intended to limit the invention to those embodiments. On the contrary, it is intended to cover all alternatives, modifications and equivalents that may be included within the spirit and scope of the invention.

For a general understanding of the features of the invention, reference is made to the drawings. In the drawings, like reference numerals have been used throughout to designate like elements.

FIG. 1 is a schematic illustration of an internal combustion engine, including a block diagram of an engine revolution speed control apparatus.

A gasoline engine (hereinafter, simply referred to as "engine") 11 is illustratively an in-line 4-cylinder gasoline engine for a vehicle. The engine 11 has a cylinder block 13 provided with reciprocating pistons 12, an oil pan 13*a* disposed below the cylinder block 13, and a cylinder head 14 disposed on top of the cylinder block 13.

A crankshaft 15, that is, an output shaft of the engine 11, is rotatably supported in a lower portion of the engine 11. The crankshaft 15 is connected to the pistons 12 via connecting rods 16. Reciprocating movements of the pistons 12 are converted into rotations of the crankshaft 15 by the connecting rods 16. A combustion chamber 17 is defined over each piston 12. Each combustion chamber 17 is connected to an exhaust passage 18 and an intake passage 19. The exhaust passage 18 is opened and closed to each combustion chamber 17 by corresponding exhaust valves 20. The intake passage 19 is opened and closed to each combustion chamber 17 by corresponding intake valves 21.

An exhaust camshaft 22 and an intake camshaft 23 extend on the cylinder head 14 parallel to each other and also to the crankshaft 15. The exhaust camshaft 22 is supported on the cylinder head 14 rotatably, but immovably along the axis of the exhaust camshaft 22. The intake camshaft 23 is supported on the cylinder head 14, rotatably and movably, in the directions of an axis of the intake camshaft 23.

A timing pulley 24*a* is provided at an end of the exhaust camshaft 22. A valve lift varying actuator 25, provided with a timing pulley 25*a*, is provided at an end of the intake camshaft 23, the end being close to the timing pulley 24*a* of the exhaust camshaft 22. The valve lift varying actuator 25 moves the intake camshaft 23 along the axis thereof to change a contact cam profile of a three-dimensional cam as described below. This is performed so as to adjust the valve lift and the open valve duration of the intake valves 21.

The timing pulleys 24*a*, 25*a* are connected to a timing pulley 15*a* mounted to the crankshaft 15, via a timing belt 26. Rotational movement is transmitted from the crankshaft 15, that is, a driving rotational shaft, to the exhaust camshaft 22 and the intake camshaft 23, that is, driven rotational shafts, via the timing belt 26. As a result, the exhaust camshaft 22 and the intake camshaft 23 rotate synchronously with the crankshaft 15.

The exhaust camshaft 22 has exhaust cams 27, which each contact an upper end portion of a corresponding one of the exhaust valves 20 via a valve lifter. The intake camshaft 23 has intake cams 28 each contacting an upper end portion of a corresponding one of the intake valves 21 via a valve lifter. Therefore, if the exhaust camshaft 22 and the intake camshaft 23 rotate, the exhaust valves 20 and the intake valves 21 are opened and closed in accordance with cam profiles of the exhaust cams 27 and profiles of the intake cams 28, respectively.

Figure 2:
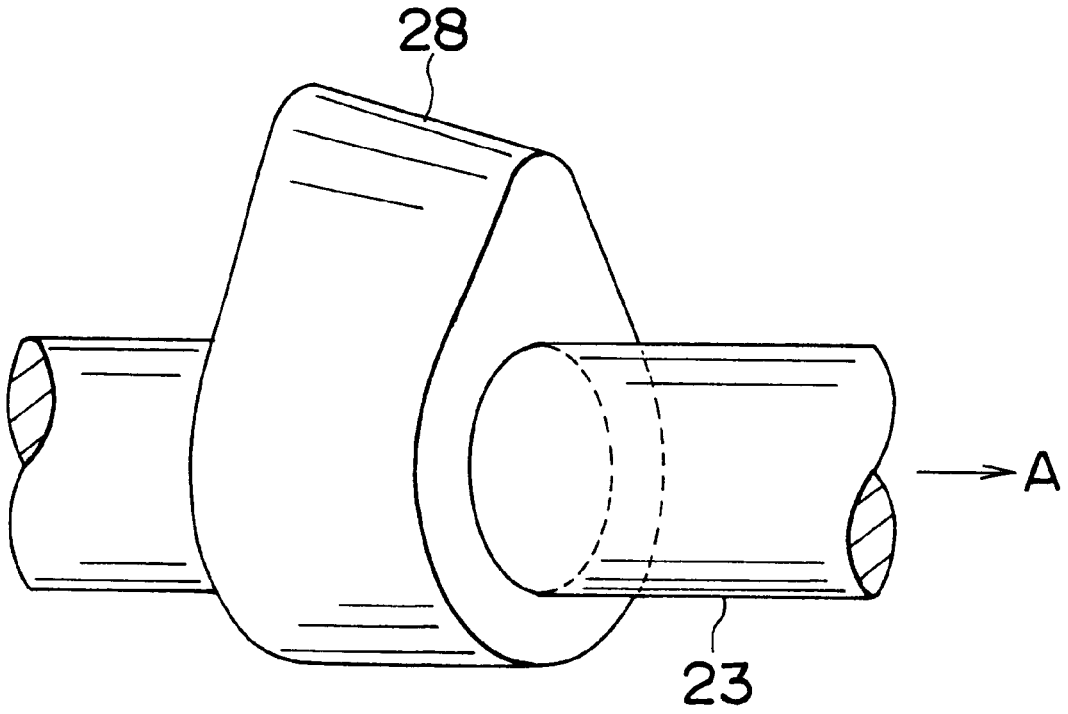
FIG. 2 is a perspective view of an intake cam according to the first embodiment of the invention.

The cam profile of each exhaust cam 27 is uniform with respect to the directions of the axis of the exhaust camshaft 22, whereas the cam profile of each intake cam 28 continuously changes with respect to the direction of the axis of the intake camshaft 23 as shown in FIG. 2. That is, each intake cam 28 is a three-dimensional cam.

Therefore, if the intake camshafts 23 are gradually moved in a direction indicated by arrow A in FIG. 2, the lift of the intake valves 21, caused by the intake cams 28, gradually and continuously increases. Correspondingly, the opening timing of the intake valves 21 advances and the closing timing thereof delays, so that the open valve duration gradually and continuously increases. If the intake cams 28 are moved in the direction opposite to the direction of arrow A, the lift of the intake valves 21, caused by the intake cams 28, gradually and continuously decreases. Correspondingly, the opening timing of the intake valves 21 delays and the closing timing thereof advances. As a result, the open valve duration gradually and continuously decreases.

Thus, the open valve duration and the lift of the intake valves 21 can be continuously adjusted by moving the intake camshaft 23 in the directions of its axis.

The valve lift varying actuator 25 and a fluid supplying arrangement for hydraulically driving the valve lift varying actuator 25 will hereinafter be described with reference to FIG. 3.

Figure 3:
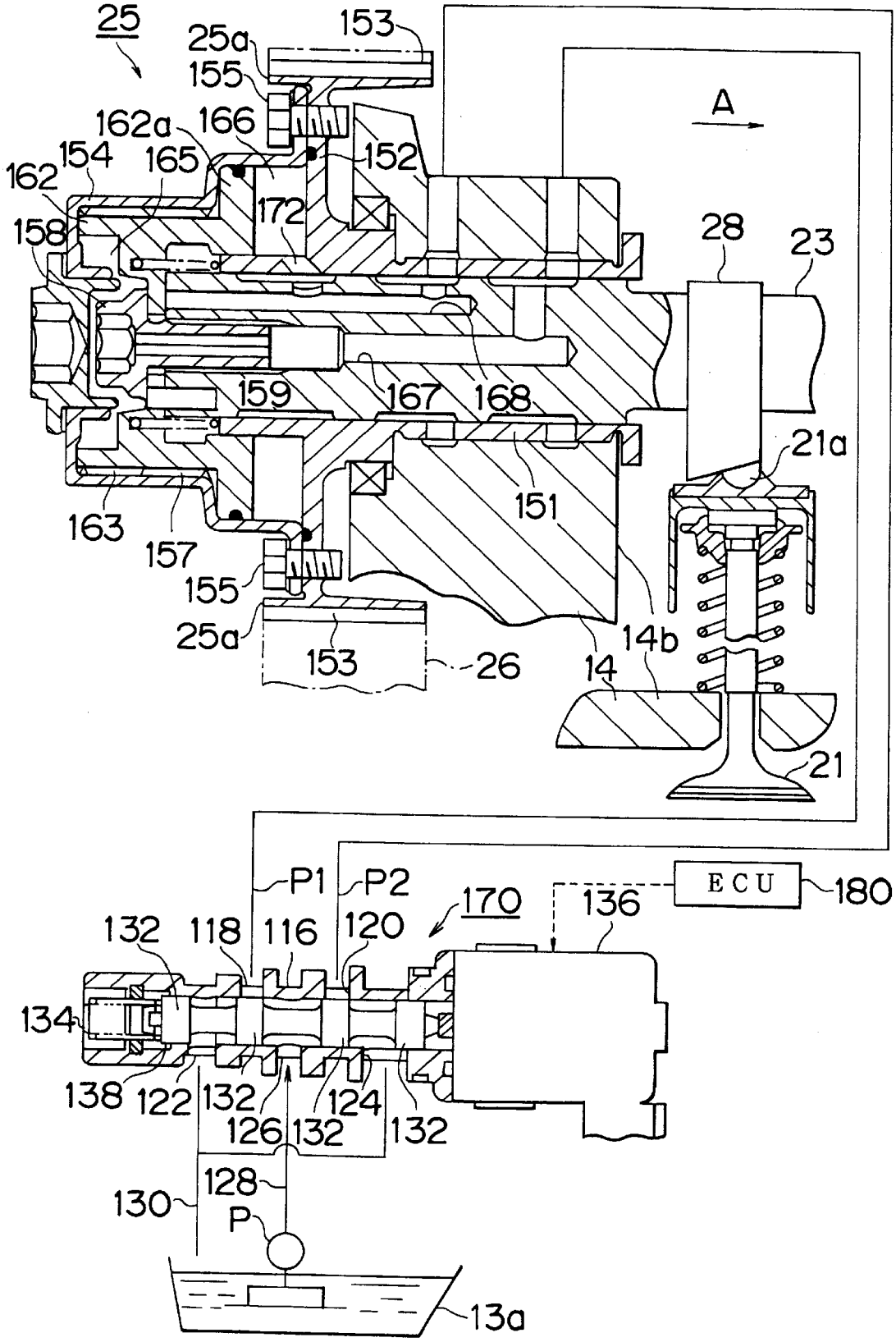
FIG. 3 illustrates the arrangement of a valve lift varying actuator according to the first embodiment of the invention.

As shown in FIG. 3, the valve lift varying actuator 25 is provided with the timing pulley 25*a*. The timing pulley 25*a* has a tubular portion 151 through which the intake camshaft 23 extends, a disc portion 152 protruding from an outer peripheral surface of the tubular portion 151, and a plurality of external teeth 153 formed in an outer peripheral surface of the disc portion 152. The tubular portion 151 of the timing pulley 25*a* is rotatably supported on a bearing portion 14*b* of the cylinder head 14. The intake camshaft 23 extends through the tubular portion 151 in such a manner that the intake camshaft 23 can be moved along its axis.

A cover 154 is secured to the timing pulley 25*a* by bolts 155 in such a manner as to cover an end portion of the intake camshaft 23. A plurality of internal teeth 157 are arranged in circumferential directions in an inner peripheral surface of the cover 154, at a position corresponding to the end portion of the intake camshaft 23. Each of the internal teeth 157 linearly extends along the axis of the intake camshaft 23.

A tubular ring gear 162 is secured to the end of the intake camshaft 23 by a hollow bolt 158 and a pin 159. The ring gear 162 has, on its outer peripheral surface, spur teeth 163 that mesh with the internal teeth 157 of the cover 154. Each of the spur teeth 163 linearly extends along the axis of the intake camshaft 23. Therefore, the ring gear 162 is movable together with the intake camshaft 23 along the axis of the intake camshaft 23.

In the valve lift varying actuator 25, constructed as described above, the timing pulley 25*a* is rotated together with the intake camshaft 23. This rotation is a result of a rotating force transmitted thereto from the crankshaft 15 via the timing belt 26, when the engine 11 is operated. As the intake camshaft 23 rotates, the intake valves 21 are opened and closed.

If the ring gear 162 is moved toward the timing pulley 25*a* (rightward as shown in FIG. 3) by a mechanism described below, the intake camshaft 23 is moved together with the ring gear 162 in the direction indicated by arrow A (rightward in FIG. 3). As the intake camshaft 23, carrying the intake cams 28, is moved in the direction of arrow A, the cam profile of each intake cam 28, i.e., a three-dimensional cam, that contacts a cam follower 21*a* of the corresponding intake valve 21 gradually and continuously changes so as to increase the valve lift and lengthen the open valve duration, that is, advance the opening timing of the intake valve 21 and delay the closing timing thereof.

If the ring gear 162 is moved toward the cover 154 (left as shown in FIG. 3), the intake camshaft 23 is moved together with the ring gear 162 in the direction opposite to the direction of arrow A. As the intake camshaft 23 is moved in that direction (left as shown in FIG. 3), the cam profile of each intake cam 28 (three-dimensional cam) that contacts the cam follower 21*a* of the corresponding intake valve 21 gradually and continuously changes so as to decrease the valve lift and shorten the open valve duration, that is, delay the opening timing of the intake valve 21 and advance the closing timing thereof. An arrangement for hydraulically controlling the movement of the ring gear 162 will be described below.

A space inside the cover 154 is divided into a high-valve lift pressure chamber 165 and a low-valve lift pressure chamber 166 by the ring gear 162. More specifically, an outer peripheral surface of a disc-shaped ring portion 162*a* of the ring gear 162, tightly contacting an inner peripheral surface of the cover 154, provides the divider. The ring gear 162 is slidable in the directions of the axis relative the cover 154 as described above. A high-lift control fluid passage 167 and a low-lift control fluid passage 168 extend in the intake camshaft 23, and connect to the high-lift pressure chamber 165 and the low-lift pressure chamber 166, respectively.

The high-lift control fluid passage 167 communicates with the high-lift pressure chamber 165 via a hollow channel of the hollow bolt 158. The high-lift control fluid passage 167 also extends in the cylinder head 14 and connects to an oil control valve 170. The low-lift control fluid passage 168 communicates with the low-lift pressure chamber 166 via a fluid passage 172, which extends through a wall of the tubular portion 151 of the timing pulley 25*a*. The low-lift control fluid passage 168 also extends in the cylinder head 14 and connects to the oil control valve 170.

The oil control valve 170 is also connected to a supply passage 128 and a discharge passage 130. The supply passage 128 connects to the oil pan 13*a* via an oil pump P. The discharge passage 130 connects directly to the oil pan 13*a*.

The oil control valve 170 has a casing 116 that is provided with a first supply-discharge port 118, a second supply-discharge port 120, a first discharge port 122, a second discharge port 124, and a supply port 126. The first supply-discharge port 118 is connected to a fluid passage P1. The second supply-discharge port 120 is connected to a fluid passage P2. The supply port 126 is connected to the supply passage 128 for supplying hydraulic fluid from the oil pump P. The first discharge port 122 and the second discharge port 124 are connected to the discharge passage 130 for discharging hydraulic fluid to the oil pan 13*a*. A spool 138 having four valve portions 132 is disposed in the casing 116. The casing 116 is urged in one direction by a coil spring 134, and in a reverse direction by an electromagnetic solenoid 136.

When the electromagnetic solenoid 136 is de-energized, the spool 138 is positioned at an end of the casing 116 (right side as shown in FIG. 3) by a force from the coil spring 134. As a result, the first supply-discharge port 118 communicates with the first discharge port 122, and the second supply-discharge port 120 communicates with the supply port 126. In this state, hydraulic fluid is supplied from the oil pan 13*a* to the low-lift pressure chamber 166 via the supply passage 128, the oil control valve 170, the fluid passage P2, the low-lift control fluid passage 168 and the fluid passage 172. At the same time, hydraulic fluid is returned from the high-lift pressure chamber 165 to the oil pan 13*a* via the high-lift control fluid passage 167, the fluid passage P1, the oil control valve 170 and the discharge passage 130. As a result, the ring gear 162 is moved together with the intake camshaft 23 in the direction opposite to the direction of arrow A, as shown in FIG. 3, for example. As a result, a low-lift side portion of each intake cam 28 contacts the cam follower 21*a* of the corresponding intake valve 21. Therefore, the lift of the intake valves 21 decreases and the open valve duration thereof shortens. FIG. 3 shows a state where the valve lift becomes minimum.

When the electromagnetic solenoid 136 is energized, the spool 138 is positioned at the other end side of the casing 116 (the left side in FIG. 3) against the force from the coil spring 134. As a result, the second supply-discharge port 120 communicates with the second discharge port 124, and the first supply-discharge port 118 communicates with the supply port 126. In this state, hydraulic fluid is supplied from the oil pan 13*a* to the high-lift pressure chamber 165 via the supply passage 128, the oil control valve 170, the fluid passage P1 and the high-lift control fluid passage 167. At the same time, hydraulic fluid is returned from the low-lift pressure chamber 166 to the oil pan 13*a* via the fluid passage 172, the low-lift control fluid passage 168, the fluid passage P2, the oil control valve 170 and the discharge passage 130. As a result, the ring gear 162 is moved together with the intake camshaft 23 in the direction of arrow A, so that a high-lift portion of each intake cam 28 contacts the cam follower 21*a* of the corresponding intake valve 21. Therefore, the valve lift and the open valve duration of the intake valves 21 increase.

When the spool 138 is positioned in an intermediate portion of the casing 116, by correspondingly controlling the power supply to the electromagnetic solenoid 136, the first supply-discharge port 118 and the second supply-discharge port 120 are closed. As a result, hydraulic fluid is prevented from moving via those ports. In this state, hydraulic fluid is not supplied to or discharged from the high-lift pressure chamber 165 or the low-lift pressure chamber 166. Rather, the amounts of hydraulic fluid in the two chambers are maintained, so that the ring gear 162 is fixed in position. Therefore, the cam profile of each intake cam 28 contacting the corresponding cam follower 21*a* becomes fixed, so that the valve lift and the predetermined open valve duration of the intake valves 21 are maintained.

A valve lift adjusting ECU (electronic control unit) 180 for controlling the oil control valve 170, in a manner as described above, is formed by a microcomputer having a CPU 182, a ROM 183, a RAM 184, a backup RAM 185, for example, as shown in FIG. 1.

The ROM 183 is a memory that stores various control programs and maps used as references when the various control programs are executed, for example. The CPU 182 executes computations based on the control programs stored in the ROM 183. The RAM 184 is a memory for temporarily storing results of computations executed by CPU 182 and data inputted from various sensors, for example. The backup RAM 185 is a non-volatile memory for storing data that needs to be retained, even after the engine 11 is stopped. The CPU 182, the ROM 183, the RAM 184 and the backup RAM 185 are connected to one another, and also to an external input circuit 187 and an external output circuit 188, by a bus 186.

The external input circuit 187 are connected to various sensors for detecting operating conditions of the engine 11. These sensors may include an intake pressure sensor and a throttle sensor, for example. The external input circuit 187 is also connected to a crank-side electromagnetic pickup 190 and a shaft position sensor 194. The crank-side electromagnetic pickup 190 (corresponding to an engine revolution speed detecting device) detects the rotational phase and the rotation speed (corresponding to engine revolution speed) of the crankshaft 15. The shaft position sensor 194 (corresponding to an adjustment amount detecting device) detects the position of the intake camshaft 23 in the directions of its axis. The external output circuit 188 is connected to the oil control valve 170.

The ECU 180 sends signals to and receives signals from an fuel injection controlling ECU 200, via the external input circuit 187 and the external output circuit 188. The signals are necessary for control operations of the ECU 180 and the ECU 200.

In accordance with this embodiment, the ECU 180 controls the valve characteristics of the intake valves 21. The ECU 180 may determine, on the basis of detection signals from the various sensors for detecting the operating conditions of the engine 11, that it is necessary to adjust the valve lift and the open valve duration of the intake valves 21. This may be necessary in order to achieve an appropriate condition of the engine 11. Accordingly, the ECU 180 performs corresponding drive control of the oil control valve 170. For example, using, as parameters, the engine revolution speed detected by the crank-side electromagnetic pickup 190 and the engine load obtained from the intake pressure sensor or the ECU 200, the ECU 180 determines a target shaft position of the intake camshaft 23 (corresponding to a target valve lift). This determination is performed on the basis of a map. Then, the ECU 180 drives the valve lift varying actuator 25 so that the intake camshaft 23 is positioned at the target shaft position.

During this drive control, the ECU 180 determines a present shaft position of the intake camshaft 23 along its axis. This determination is made on the basis of a detection signal from the shaft position sensor 194. Then, the ECU 180 performs feedback control of the valve lift varying actuator 25 via the oil control valve 170. As a result, the intake camshaft 23 assumes the target shaft position for achieving the target valve lift and the target open valve duration of the intake valves 21.

Figure 4:
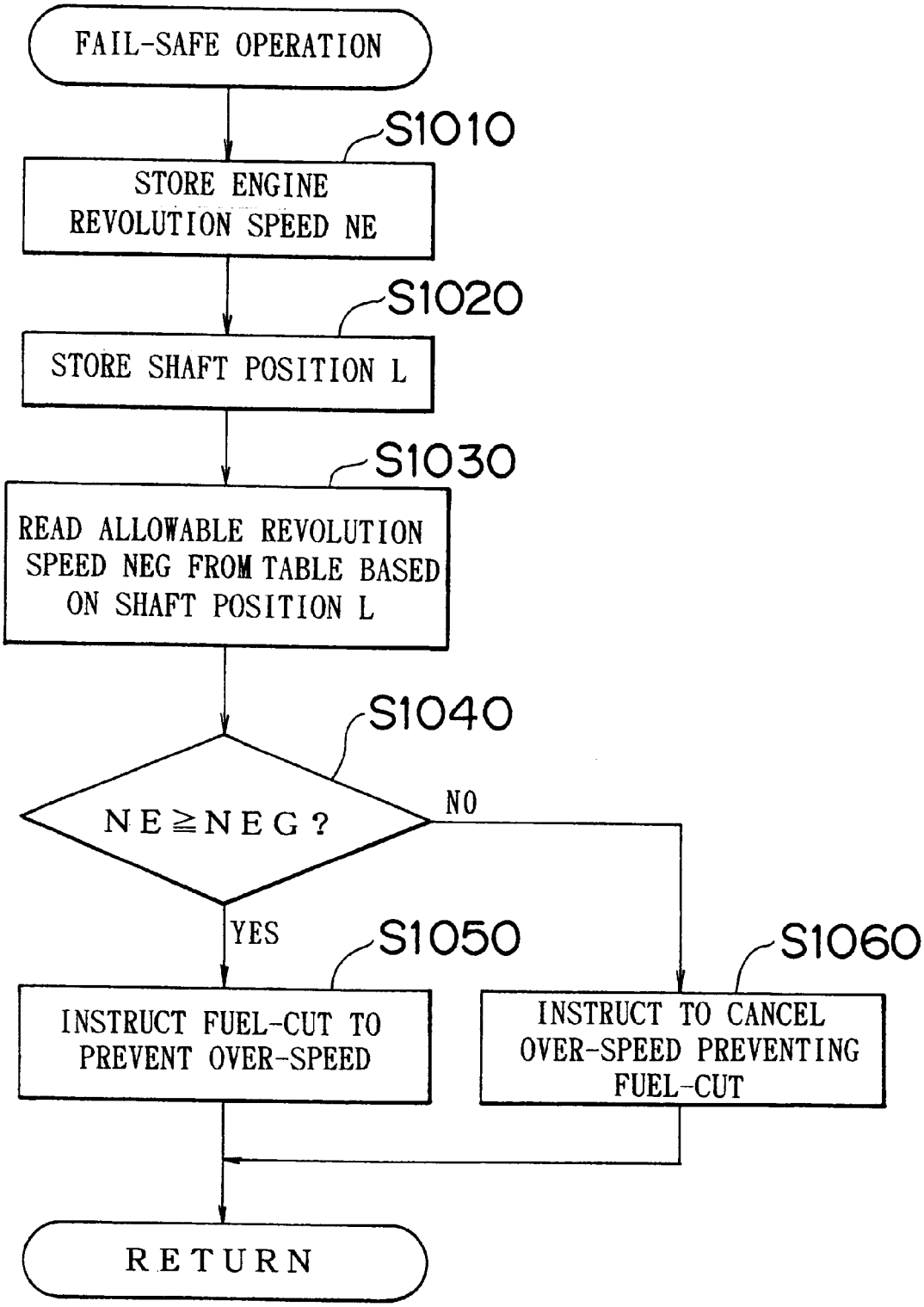
FIG. 4 is a flowchart showing a fail-safe operation performed by a valve lift adjusting ECU (electronic control unit) in the first embodiment of the invention.

In addition to the above-described operation, the ECU 180 executes a fail-safe operation illustrated by the flowchart in FIG. 4. The fail-safe operation is repeatedly executed in a constant time length cycle or a constant crank angle. Steps in the flowchart, corresponding to various operations, are represented by reference numerals led by "S".

When the fail-safe is started, the ECU 180 stores an engine revolution speed NE calculated based on a detection value obtained from the crank-side electromagnetic pickup 190. The engine revolution speed NE is stored in a working memory provided in the RAM 184 in step S1010. Subsequently in step S1020, the ECU 180 stores a shaft position L, calculated based on a detection value obtained from the shaft position sensor 194, into the working memory of the RAM 184.

Subsequently in step S1030, the ECU 180 determines an allowable revolution speed NEG corresponding to the shaft position L, by using a table stored in the ROM 183. The table provides a relationship between the shaft position L and the allowable revolution speed NEG.

Figure 5:
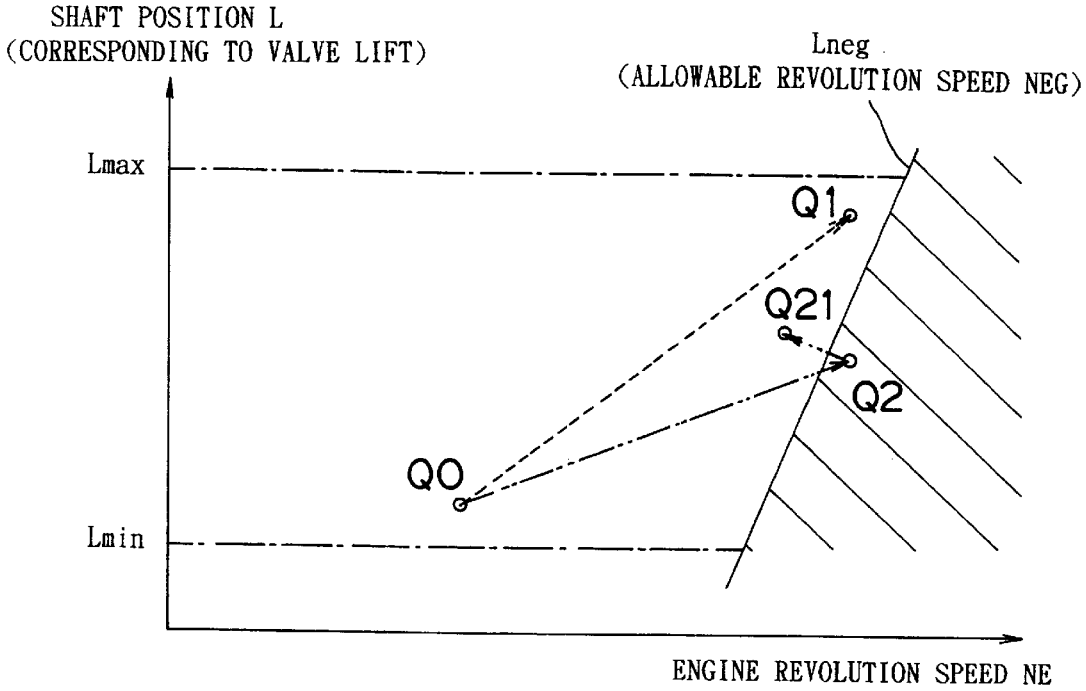
FIG. 5 is a graph showing a relationship between the engine revolution speed and the shaft position.

The table is set, for example, as indicated by a solid line Lneg shown in FIG. 5. The allowable revolution speed NEG will tend to continuously increase with increases in the value of the shaft position L. This table setting has been adapted to the characteristic of the engine 11 that the allowable revolution speed NEG increases as the lift of the intake valves 21 increases as described above. In this embodiment, the lift of the intake valves 21 increases as the detected value of the shaft position L detected by the shaft position sensor 194 increases. A shaft position Lmax corresponds to a maximum valve lift, and a shaft position Lmin corresponds to a minimum valve lift.

Subsequently in step S1040, the ECU 180 determines whether the actual engine revolution speed NE, stored in step S1010, is equal to or greater than the allowable revolution speed NEG. If NE≧NEG (YES in step S1040), the operation proceeds to step S1050. In step S1050, the ECU 180 sends a fuel-cut instruction signal to the ECU 200 in order to prevent over-speed engine revolution. Subsequently, the fail-safe operation temporarily ends. In response to the instruction signal, the ECU 200 stops fuel injection to the engine 11, so that the revolution speed of the engine 11 decreases.

If the actual engine revolution speed NE is lower than the allowable revolution speed NEG as a result of the above-described engine speed reduction or as a result of the beginning speed of the engine (NO in step S1040), the operation proceeds to step S1060. In step S1060, the ECU 180 sends an over-speed preventing fuel-cut canceling instruction to the ECU 200. Therefore, fuel injection is resumed or continued. It should be noted herein that if fuel-cut is being performed by a different control operation, fuel injection is not resumed or continued merely by execution of step S1060.

As long as the responsiveness of the valve lift varying actuator 25 is normal, an increase in the engine revolution speed NE from a state Q0 as indicated in FIG. 5 is followed by a corresponding movement of the intake camshaft 23 in the direction of arrow A in FIGS. 1–3, whereby the lift of the intake valves 21 caused by the intake cams 28 is increased (state Q1). Since the allowable revolution speed NEG also increases as indicated in FIG. 5, the engine revolution speed NE does not become greater than the allowable revolution speed NEG.

However, if the valve lift varying actuator 25 has an abnormality or a responsiveness reduction for any reason, an increase in the engine revolution speed NE, from the state Q0, is not followed by a prompt movement of the intake camshaft 23 in the direction of arrow A. As a result, a sufficient increase in the valve lift is not achieved. In this case, therefore, an increase in the engine revolution speed NE is likely to result in a shift to a state Q2 where the actual engine revolution speed NE exceeds the allowable revolution speed NEG. If such an event happens, the step S1050 is executed, whereby the engine revolution speed NE is decreased to establish a state Q21 where the actual engine revolution speed NE is lower than the allowable revolution speed NEG.

In this embodiment, step S1030 corresponds to an operation of an allowable revolution speed setting device. Steps S1040 and S1050 correspond to an operation of an engine revolution speed reducing device.

As is apparent from the above description, this embodiment of the invention detects an actual amount of adjustment achieved by the valve lift varying actuator 25 by using the shaft position sensor 194. As a result, the embodiment is able to determine a cam profile of each intake cam 28 contacting the corresponding cam follower 21 a. That is, the embodiment is capable of determining what portion of the oblique cam surface of each intake cam 28 is in contact with the corresponding cam follower 21*a* and, therefore, is achieving a present valve lift. Since such a valve lift cam profile is thus specified, in addition to other parameters involved in determining an allowable revolution speed NEG, including the valve spring load, the valve mass, and the like, it becomes possible to set a precise allowable revolution speed NEG.

Therefore, the allowable revolution speed NEG can be set so as to vary continuously with continuos changes in the valve lift as shown in FIG. 5. As a result, it becomes possible to properly determine the state of an actual engine revolution speed NE, that is, whether the actual engine revolution speed NE is appropriate. This is accomplished on the basis of the allowable revolution speed NEG. More specifically, if an engine revolution speed NE is equal to or higher than the present allowable revolution speed NEG, a fuel-cut is performed to reduce the revolution speed of the engine 11 to an appropriate level. The embodiment in accordance with the invention thus realizes a proper fail-safe system and prevents problems with the engine 11.

In the foregoing embodiment, the valve lift adjusting ECU 180 and the fuel injection controlling ECU 200 are provided as separate components. However, it is also possible to provide a single ECU that performs the valve lift adjusting control, the fail-safe operation, and the fuel injection control.

Figure 6:
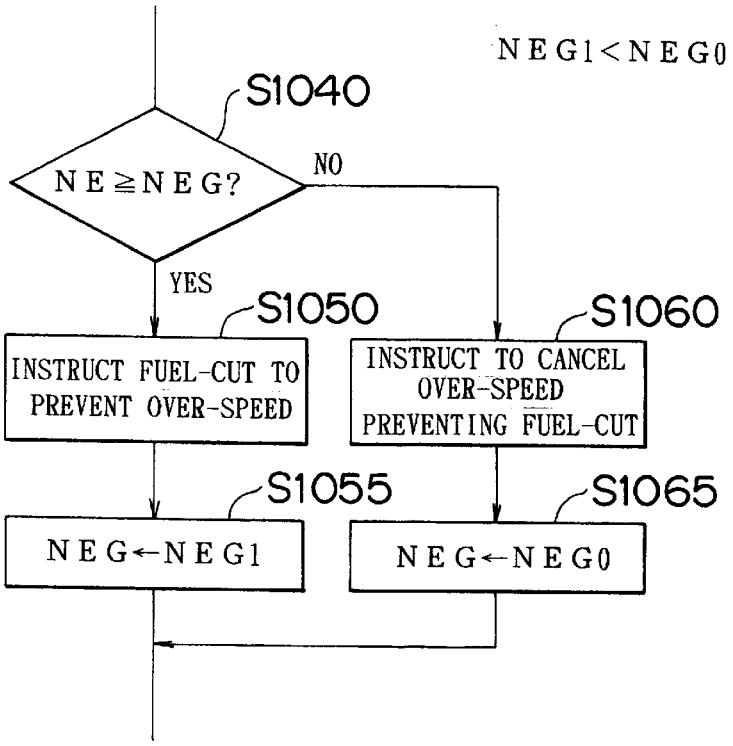
FIG. 6 is a flowchart illustrating a portion of a fail-safe operation according to a second embodiment of the invention.

It is also possible to provide hysteresis for the determination in step S1040. That is, as shown in FIG. 6, if the determination in step S1040 is affirmative, the subsequent step S1050 is followed by step S1055. In step S1055, the allowable revolution speed NEG is set to NEG1. If the determination in step S1040 is negative, the subsequent step S1060 is followed by step S1065, in which the allowable revolution speed NEG is set to NEG0, where NEG1<NEG0. The provision of such hysteresis prevents problematic discontinuaties in generated power between implementation and discontinuation of the fuel-cut operation and therefore prevents deterioration in drivability.

Furthermore, in the foregoing embodiments, if the actual engine revolution speed NE becomes equal to or higher than the allowable revolution speed NEG, the engine revolution speed NE is reduced by a fuel-cut. However, it is also possible to reduce the engine revolution speed NE by an engine torque reduction. This may be achieved by reducing the throttle opening.

Still further, in the foregoing embodiments, the valve lift varying actuator 25 is provided on the side of the intake camshaft 23. However, a construction may instead be adopted in which the intake cams 28 are normal cams and the exhaust cams 27 are three-dimensional cams and, therefore, a valve lift varying actuator is provided on the side of the exhaust camshaft 22. Another construction in which the exhaust cams 27 and the intake cams 28 are three-dimensional cams and valve lift varying actuators are provided for both the exhaust camshaft 22 and the intake camshaft 23 may also be adopted.

While the invention has been described in conjunction with specific embodiments thereof, it is evident that many alternatives, modifications and variations may be apparent to those skilled in the art. Accordingly, the exemplary embodiments of the invention as set forth herein are intended to be illustrative, not limiting. Various changes may be made without departing from the spirit and scope of the invention.

What is claimed is:

1. A revolution speed control apparatus for an internal combustion engine having a camshaft, comprising:

a three-dimensional cam provided on the camshaft of the internal combustion engine, the three-dimensional cam having a cam surface that contacts a cam follower drivingly connected to a valve, the three-dimensional cam having a cam profile that varies continuously along a rotational axis of the three-dimensional cam;

a valve lift varying actuator capable of continuously varying a valve lift of the valve by adjusting a position of the camshaft along the rotational axis of the three-dimensional cam, the valve lift of the valve caused by the three-dimensional cam;

an adjustment amount detector that detects an amount of adjustment provided by the valve lift varying actuator;

an allowable revolution speed setter that determines an allowable revolution speed of the internal combustion engine based on an amount of adjustment detected by the adjustment amount detector, an engine revolution speed detector that detects a revolution speed of the internal combustion engine; and an engine revolution speed reducer that reduces the revolution speed of the internal combustion engine if the revolution speed detected by the engine revolution speed detector is greater than the allowable revolution speed set by the allowable revolution speed setter.

2. The revolution speed control apparatus according to claim 1, wherein the allowable revolution speed setter sets the allowable revolution speed by continuously varying the allowable revolution speed based on the valve lift corresponding to the amount of adjustment.

3. The revolution speed control apparatus according to claim 2, wherein the allowable revolution speed setter sets the allowable revolution speed so that the allowable revolution speed increases with increases in the valve lift based on the amount of adjustment.

4. The revolution speed control apparatus according to claim 1, wherein the engine revolution speed reducer reduces the revolution speed of the internal combustion engine by stopping a fuel supply to the internal combustion engine.

5. The revolution speed control apparatus according to claim 4, wherein the allowable revolution speed setter sets the allowable revolution speed by continuously varying the allowable revolution speed based on the valve lift corresponding to the amount of adjustment.

6. The revolution speed control apparatus according to claim 5, wherein the allowable revolution speed setter sets the allowable revolution speed so that the allowable revolution speed increases with increases in the valve lift based on the amount of adjustment.

7. The revolution speed control apparatus according to claim 1, wherein the engine revolution speed reducer reduces the revolution speed of the internal combustion engine by reducing a throttle opening.

8. The revolution speed control apparatus according to claim 7, wherein the allowable revolution speed setter sets the allowable revolution speed by continuously varying the allowable revolution speed based on the valve lift corresponding to the amount of adjustment.

9. The revolution speed control apparatus according to claim 8, wherein the allowable revolution speed setter sets the allowable revolution speed so that the allowable revolution speed increases with increases in the valve lift based on the amount of adjustment.

10. A revolution speed control apparatus for an internal combustion engine having a camshaft, comprising:

a three-dimensional cam provided on the camshaft of the internal combustion engine, the three-dimensional cam having a cam surface that contacts a cam follower drivingly connected to a valve, the three-dimensional cam having a cam profile that varies continuously along a rotational axis of the three-dimensional cam;

a valve lift varying actuator capable of continuously varying a valve lift of the valve by adjusting a position of the camshaft along the rotational axis of the three-dimensional cam, the valve lift of the valve caused by the three-dimensional cam;

adjustment amount detecting means for detecting an amount of adjustment provided by the valve lift varying actuator, allowable revolution speed setting means for determining an allowable revolution speed of the internal combustion engine based on an amount of adjustment detected by the adjustment amount detector, engine revolution speed detection means for detecting a revolution speed of the internal combustion engine; and engine revolution speed reduction means for reducing the revolution speed of the internal combustion engine if the revolution speed detected by the engine revolution speed detection means is greater than the allowable revolution speed set by the allowable revolution speed setting means.

11. The revolution speed control apparatus according to claim 10, wherein the allowable revolution speed setting means sets the allowable revolution speed by continuously varying the allowable revolution speed based on the valve lift corresponding to the amount of adjustment.

12. The revolution speed control apparatus according to claim 11, wherein the allowable revolution speed setting means sets the allowable revolution speed so that the allowable revolution speed increases with increases in the valve lift based on the amount of adjustment.

13. The revolution speed control apparatus according to claim 10, wherein the engine revolution speed reduction means reduces the revolution speed of the internal combustion engine by stopping a fuel supply to the internal combustion engine.

14. The revolution speed control apparatus according to claim 13, wherein the allowable revolution speed setting means sets the allowable revolution speed by continuously varying the allowable revolution speed based on the valve lift corresponding to the amount of adjustment.

15. The revolution speed control apparatus according to claim 14, wherein the allowable revolution speed setting means sets the allowable revolution speed so that the allowable revolution speed increases with increases in the valve lift based on the amount of adjustment.

16. The revolution speed control apparatus according to claim 10, wherein the engine revolution speed reduction means reduces the revolution speed of the internal combustion engine by reducing a throttle opening.

17. The revolution speed control apparatus according to claim 16, wherein the allowable revolution speed setting means sets the allowable revolution speed by continuously varying the allowable revolution speed based on the valve lift corresponding to the amount of adjustment.

18. The revolution speed control apparatus according to claim 17, wherein the allowable revolution speed setting means sets the allowable revolution speed so that the allowable revolution speed increases with increases in the valve lift based on the amount of adjustment.

* * * * *